United States Patent [19]

Goldfarb

[11] 4,261,563

[45] Apr. 14, 1981

[54] ELECTRONIC TIME REACTION GAME APPARATUS

[76] Inventor: Adolph E. Goldfarb, 19434 Londelius St., Northridge, Calif. 91324

[21] Appl. No.: 971,852

[22] Filed: Dec. 21, 1978

Related U.S. Application Data

[63] Continuation-in-part of Ser. No. 876,661, Feb. 10, 1978, abandoned.

[51] Int. Cl.[3] ..... A63B 71/06; A63F 9/00

[52] U.S. Cl. ..... 273/1 E; 273/138 A

[58] Field of Search ..... 273/1 E, 85 G, 138 A, 273/237, DIG. 28; 35/22 R, 48 R

[56] References Cited

U.S. PATENT DOCUMENTS

| | | | |
|---|---|---|---|
| 2,957,693 | 10/1960 | Ross | 273/1 E |
| 3,503,608 | 3/1970 | Ylinen | 273/1 E |
| 3,558,132 | 1/1971 | Miller | 273/1 E |
| 3,563,230 | 2/1971 | Gibbs | 273/1 E |
| 3,779,553 | 12/1973 | Secter | 273/1 E |
| 3,865,368 | 2/1975 | Grazebrook | 35/22 R X |
| 4,017,072 | 4/1977 | Kurtz | 273/1 E |
| 4,060,242 | 11/1977 | Huang et al. | 273/1 E |

OTHER PUBLICATIONS

*Practical Electronics;* "Snap"; Feb., 1977; pp. 132-133.

*Popular Electronics;* "Build the Led Target Game"; Jun., 1977; pp. 50-52.

*Primary Examiner*—Vance Y. Hum

*Attorney, Agent, or Firm*—Romney, Schaap, Golant, Disner & Ashen

[57] ABSTRACT

An electronic time reaction game apparatus which is capable of being played by one or more players and which comprises a housing having a pair of opposed player ends. A microprocessor is located in the housing and may be suitably operated by a convenient source of power, e.g., conventional battery power. A pair of player actuable response switches and a plurality of player response lights are located at each player end. One of the response switches is forward acting and the other is rearward acting. The microprocessor initiates a game cycle by causing generation of a player ready signal and, after a randomly varying time interval, or apparent randomly varying time interval unknown to the player or players, initiates and causes generation of a player start signal. The player or players attempt to anticipate the action of the opponent player and select the proper one of their response switches to actuate in order to maximize their score, and after the start signal, each actuates their selected response switches as quickly as possible in order to generate a score. The generated score is depicted by energization of one or more of the lights at the player end of the player first actuating the proper response switch.

21 Claims, 6 Drawing Figures

ELECTRONIC TIME REACTION GAME APPARATUS

RELATED APPLICATION

This application is a continuation-in-part of Application Ser. No. 876,661, filed Feb. 10, 1978, entitled ELECTRONIC TIME REACTION GAME APPARATUS, now abandoned.

BACKGROUND OF THE INVENTION

1. Field of the Invention

This invention relates to certain new and useful improvements in time reaction game apparatus and, more particularly, to an electronic time reaction game apparatus in which one or more players must respond to a start signal, select a proper response and initiate a proper response in the shortest possible time to generate a score.

2. Brief Description of the Prior Art

With the advent of microprocessors, there have been a large number of games capable of being played by one or more players, and in which the microprocessor causes the generation of an action and the player attempts to respond to this action. Many games of this type are coin-operated and found in public establishments such as restaurants and the like. The microprocessor may operate in connection with a cathode ray tube to generate a game in which time action responses are required, e.g. simulated tennis or the like. In other games, the microprocessor causes generation of a battlefield in which two or more players attempt to orient their objects, e.g. tanks or similar weapons, into a proper position and to actuate a switch to shoot at the opponent's object.

There has also been a prior art game having a plate with a pair of opposed walls and a figure representative of a karate figure on both of the opposed walls of the plate. A number of lights, relatively hidden from view of the players, were located on or adjacent to the karate figure and could be energized to be simultaneously visible to opponent players on both of the opposed walls. These lights were located at strategic places on the karate figure, as for example, the elbows, knees, shoulders and the like. Each of the players were required to respond to the energized light by hitting the plate with their hands, and the first one to hit the plate in the region of the light would achieve a score.

Another prior art game which required response from a pair of opponent players involved an object, representative of a turtle, which was movable between a pair of opposed goal areas. The turtle was relatively large and movable on a floor or similar surface and not on a game board. The game device included a control box and each of the players were provided with a pair of player actuable push-button response switches on the box. The switches for each player were wired to movement of the turtle. One of the switches of each of the players was provided with a first indicia, e.g. red, and the second of the switches for each player was provided with a second indicia, e.g. white. If both players actuated red switches or white switches, the turtle would move to one player's goal area. If one play actuated a red switch and the other player a white switch, the turtle would move to the other player's goal area. Each of the players would attempt to advance the turtle toward the opponent player's goal and, by so doing, the player who advanced the object to the opponent player's end would achieve a score or win the game. If the turtle was moving toward one of the player's own goal areas, he attempted to quickly release one response switch and actuate the other in order to reverse the direction of movement of the turtle. The other player would respond by immediately actuating his other switch. The various switches of one player were shielded from view by the other player. This game was operable by a simple electric motor which caused the turtle to move in response to the opening and closing of the response switches.

OBJECTS OF THE INVENTION

It is, therefore, a primary object of the present invention to provide an electronic time reaction game apparatus which provides a player sensory perceptive ready signal and, after a randomly varying time interval or apparently randomly varying time interval, provides a player sensory perceptive start signal, and in which one or more players attempts to actuate a player actuable response means in the shortest possible time in order to generate a score.

It is another object of the present invention to provide a time reaction game of the type stated in which the game apparatus is provided with a pair of player areas and each of the player areas having a pair of player actuable response switches so that the players must anticipate an action which might reduce their scores and select the proper response switch to actuate in order to avoid a score reduction.

It is a further object of the present invention to provide a time reaction game apparatus of the type state in which sounds are generated or lights are energized in certain patterns in order to provide indication of a score having been achieved.

It is an additional object of the present invention to provide an electronic time reaction game of the type stated which can be manufactured at a relatively low cost utilizing conventional microprocessing technology.

It is another salient object of the present invention to provide a method of playing a time reaction game in which one or more players anticipates the proper response and after receiving a start signal after a randomly varying time interval, actuates either of a pair of player actuable response switches in the shortest possible time to generate a score.

With the above and other objects in view, our invention resides in the novel features of form, construction, arrangement and combination of parts presently described and pointed out in the claims.

SUMMARY OF THE DISCLOSURE

An electronic time reaction game capable of being played by one or more players. The game is comprised of a base means in the form of a housing. An electronic processing means, as for example, a conventional microprocessor, is located within the outer housing and the microprocessor is programmed, preferably by so-called "hard-wire" programming, in order to perform each of the desired actions as hereinafter described.

The housing is designed with a pair of opposed player ends and each of the player ends are provided with a pair of player actuable response switches in the form of manually actuable push-button switches. One of the switches at each player end controls a forward movement and the other of the switches at each player end controls a backward movement. In addition, a series of lights are also provided at each player end, and the series of lights extend from the player end toward the center of the housing. At the center of the housing, a large dome enclosing an electric bulb is provided and which is energized when a certain action results, as for example, one player winning the game. Each of the various lights and the response switches are operatively connected to the microprocessor for operation thereby. A sound generating mechanism, such as a conventional speaker, is located within the housing and is operatively connected to the microprocessor to generate sounds which may be amusement sounds and/or sounds indicative of the game signals, e.g. the ready signal or the start signal, or both.

When the game is played, the microprocessor initiates a first game cycle by causing generation of a player sensory perceptive ready signal. Thus, the player sensory perceptive ready signal will be initiated by the microprocessor which causes either the speaker or the lights, or both, to generate the ready signal. After a randomly varying time interval, which is unknown to the players of the game, the microprocessor causes generation of a player sensory perceptive start signal, and again the microprocessor causes either the lights or the speaker, or both, to generate the player start signal. At this point, each player attempts to actuate the proper response switch and the first to actuate a response switch wins a score.

In one aspect of the invention, only one light can be energized at either of the player ends in a game in response to actuation of any of the player actuable response switches. Thus, after the start signal, one player will each attempt to actuate the forward response switch. The player first actuating the forward response switch will enable the first of the lights at his player end to become energized. In like manner, and in response to subsequent start signals in a game cycle, each of the players will attempt to advance their own lights in sequence toward the center, that is, to achieve energization of each successive light toward the center, in order to achieve a score or to win the game. It is also possible for the players to press their reverse response switch in order to cause one of the lights at the opposed player's end to become de-energized. If both players attempt to actuate the reverse switch, the first to actuate the reverse switch will not only energize one of his lights, but de-energize one of his opponent's lights as well. Thus, the reverse switch provides a potential advantage along with the potential disadvantage which is greater than using a forward response switch. In essence the reverse switch provides a multiplying effect in providing greater scoring advantage as well as greater risk of score loss.

In view of the fact that each player may select between any of two responses, the players must anticipate what action would be taken by the opposed player and then very quickly after the start signal select and actuate the proper response switch. The player able to first energize all of his lights and the electric bulb by selecting the proper response switch to actuate and first actuating the greater number of proper response switches in each game cycle, will achieve an additional score or win the game.

One or more players may play the game of the present invention. The microprocessor may be programmed to permit play against one player in a competitive manner or, otherwise, two or more opponent players may play the game. In like manner, one player may compete against himself or herself by attempting to achieve a score against time in subsequent turns or game cycles. In this respect, the game apparatus is competitive in that one player may compete against himself or the game apparatus or two or more players may compete.

It is also possible to provide only one player response switch at each player end and, in this embodiment, the players will only attempt to first respond to the start signal and not anticipate the opponent player's proposed action. This embodiment is feasible for younger players in which only response time action is required. The embodiment in which two or more player response switches is provided at each player end demands a greater skill required in the play of the game apparatus. In like manner, it should be observed that three or more response switches could be provided at each player end. Thus one of the switches could be a forward acting switch and the second of the switches could be a reverse acting switch and the third of the switches could be a stop switch in which no movement or energization of lights results.

In a preferred embodiment of the invention, the microprocessor causes the speaker to generate the ready signal and the start signal, although the lights could be used in conjunction therewith or separately to generate the ready and start signals. When a score is achieved, one or more of the lights at the player end winning the score will be energized. This may also be accompanied by the microprocessor causing the speaker to generate additional sounds which may be indicative of score or sounds of amusement or both. At the end of a game cycle, the microprocessor may also cause the speaker to generate additional sounds of amusement or interest, as for example, music scores, or the like.

The microprocessor is programmed by conventional techniques to enable the various signals to be generated including the start signal, the ready signal and the various scoring signals. The microprocessor is also programmed in accordance with a suitable algorithm to enable the speaker to generate music or other sounds from a direct output to the speaker and without the necessity of amplification equipment or the like. However, it should be understood that conventional amplification systems, including amplifiers, filter networks and the like, could be employed.

As indicated above, various modes of play are possible with the game apparatus, e.g. a player competing against himself or the apparatus itself or where two or more opponent players may compete. The game mode may be selected by merely actuating one or more of the proper response switches to initiate a particular mode of play. In addition, the microprocessor may be programmed to generate alternate game forms and these alternate game forms may also be initiated by actuating one or more of the response switches or operating certain of the response switches in sequence. In this respect, additional selection switches could be provided to initiate any mode of play or alternate game form.

These alternate game forms may be variations of one of the above described embodiments, as for example, energizing the lights in different pattern sequences when a score is achieved. Thus, for example, two lights at a player end may be energized in sequence and on the third actuation, one of the lights is deenergized. As another alternate form of play, a player may be required to first actuate two or more response switches in succession to achieve a score. Moreover, the microprocessor could be programmed to provide a built-in handicap. Thus, one player of lesser age or skill may be given an additional amount of time to respond than another player of greater age or skill.

The game cycle is initiated by actuating one or more of the response switches. Thus, in a preferred embodiment, the game cycle begins with the first ready signal and subsequent start signal and ends when one of the players achieves energization of all of his score indicating lights. In addition, a separate start switch could be provided to initiate the start of any game cycle.

As indicated previously, the start signal occurred after a randomly varying time interval. In this respect, the microprocessor could be programmed to provide a truly randomly varying time interval. However, it is apparent that a larger number of time intervals between the ready signal and the start signal could be programmed into the microprocessor. Thus, the microprocessor could cause generation of an apparent randomly varying time interval, that is, one which may not be truly random but which appears to be random to the user or users of the game apparatus. As used herein, the term "randomly varying time interval" will therefore also include time intervals which are truly random as well as those which are only apparently random.

BRIEF DESCRIPTION OF THE DRAWINGS

Figure 1:
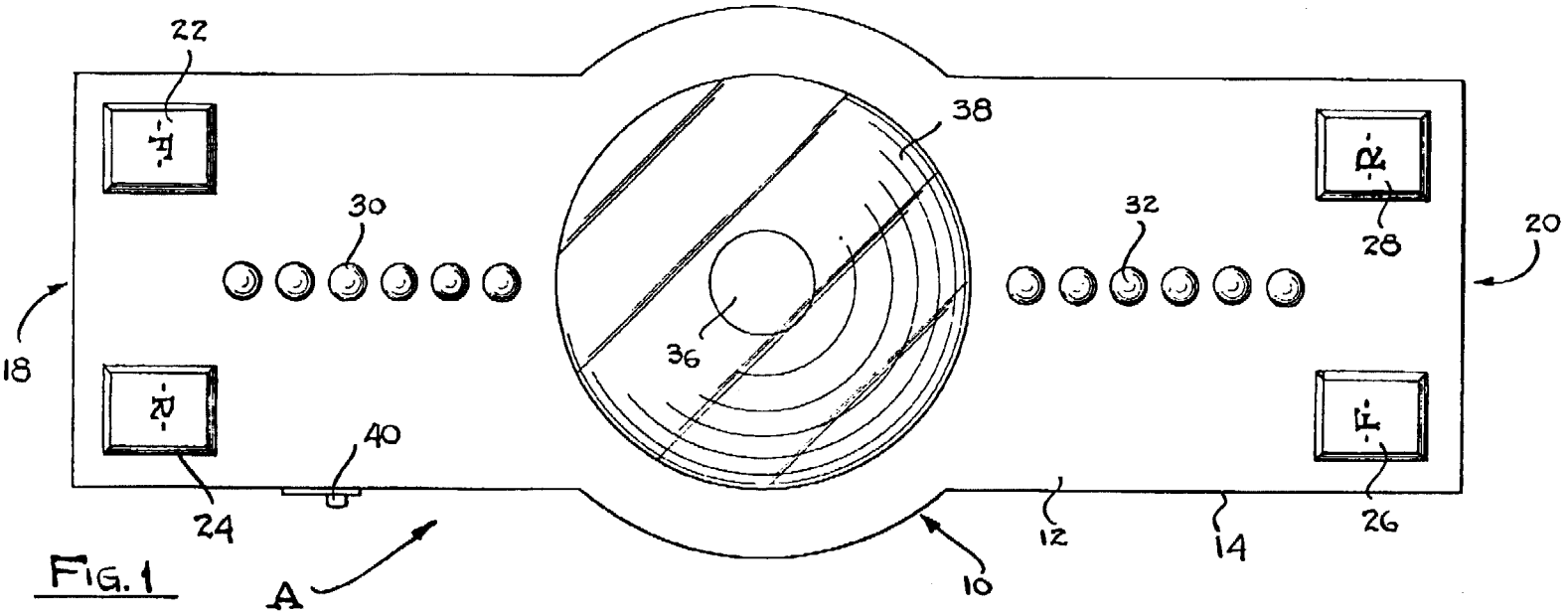
Figure 2:
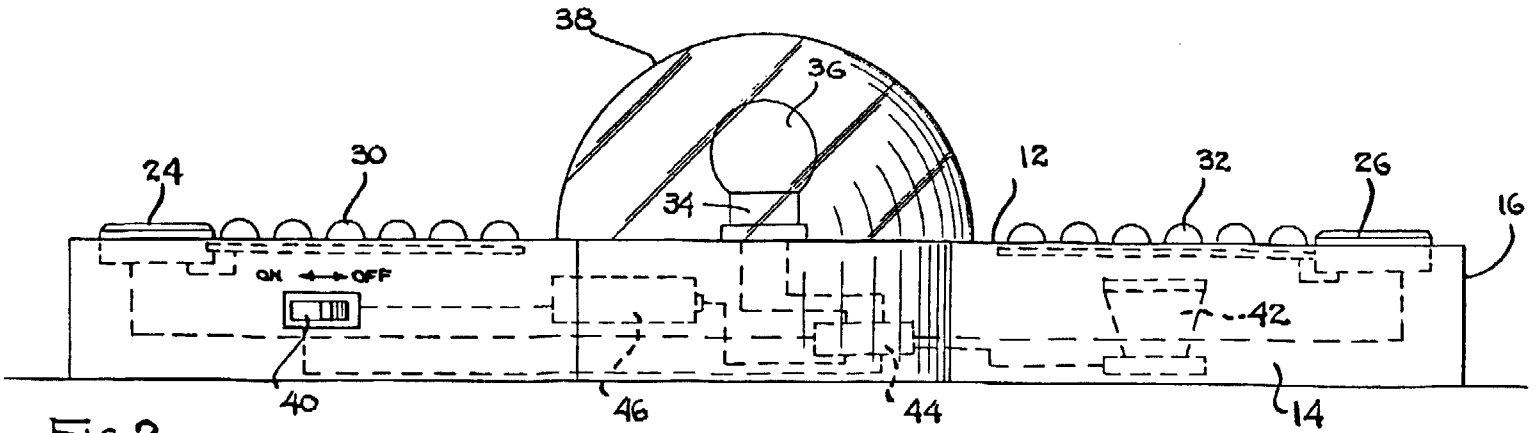
Figure 3:
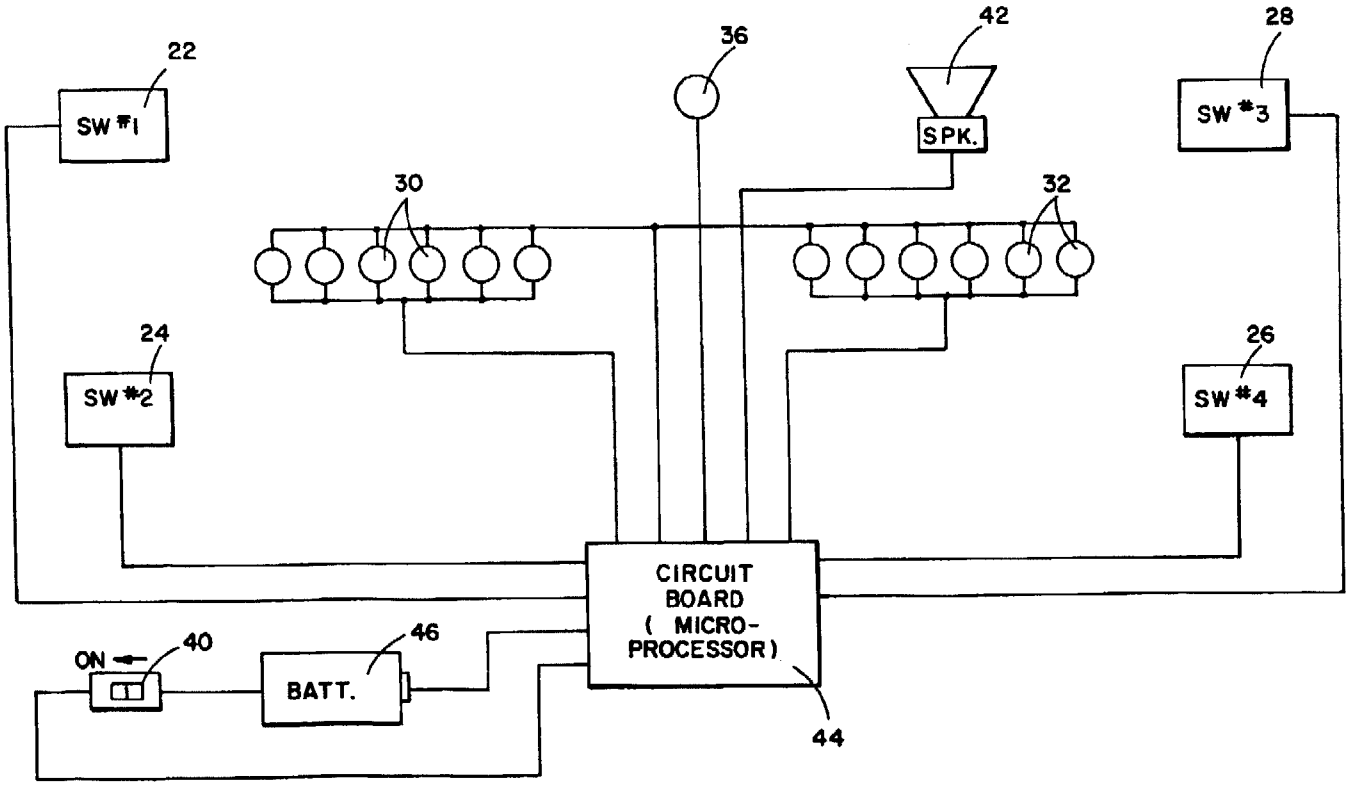
Figure 4A:
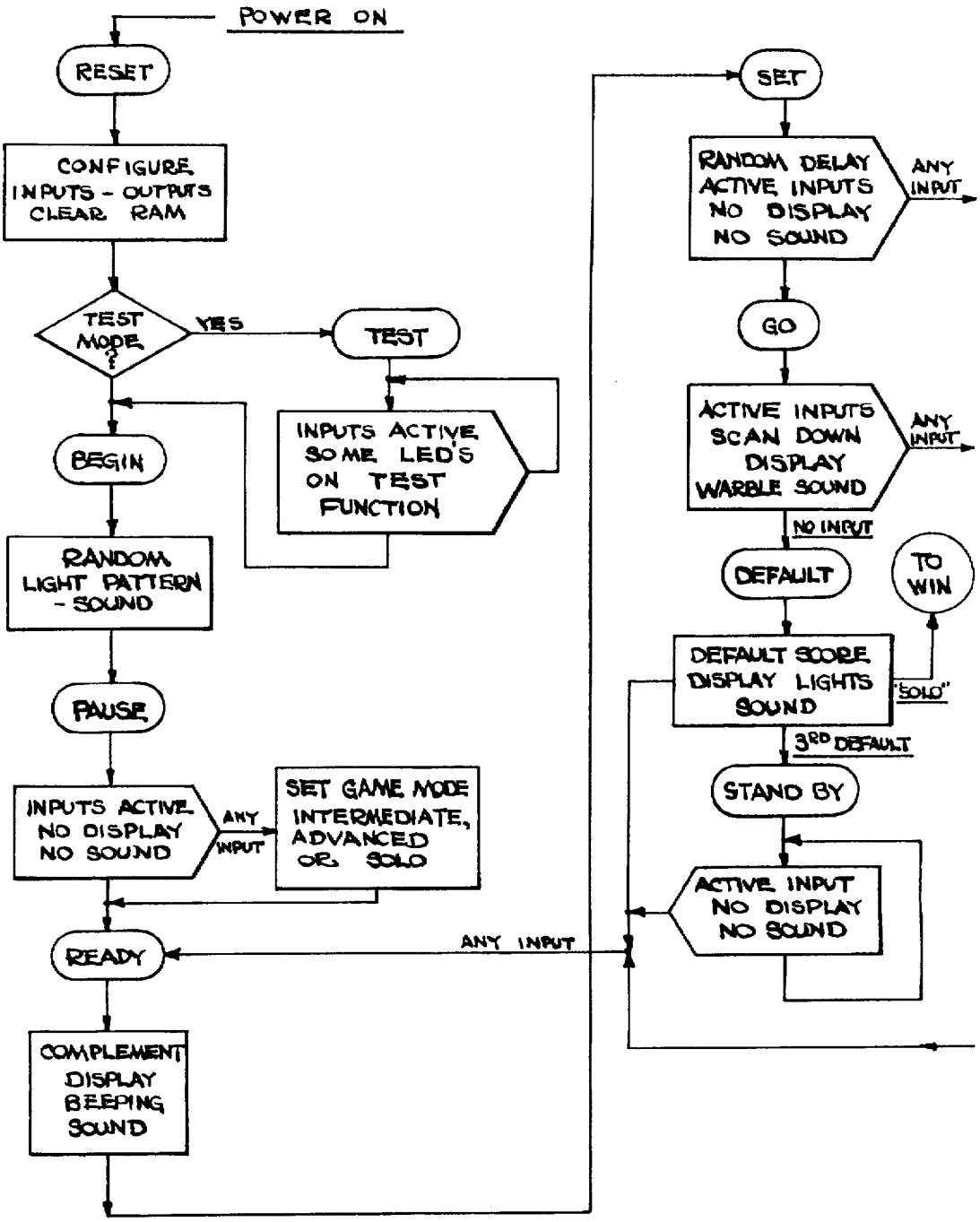
Figure 4B:
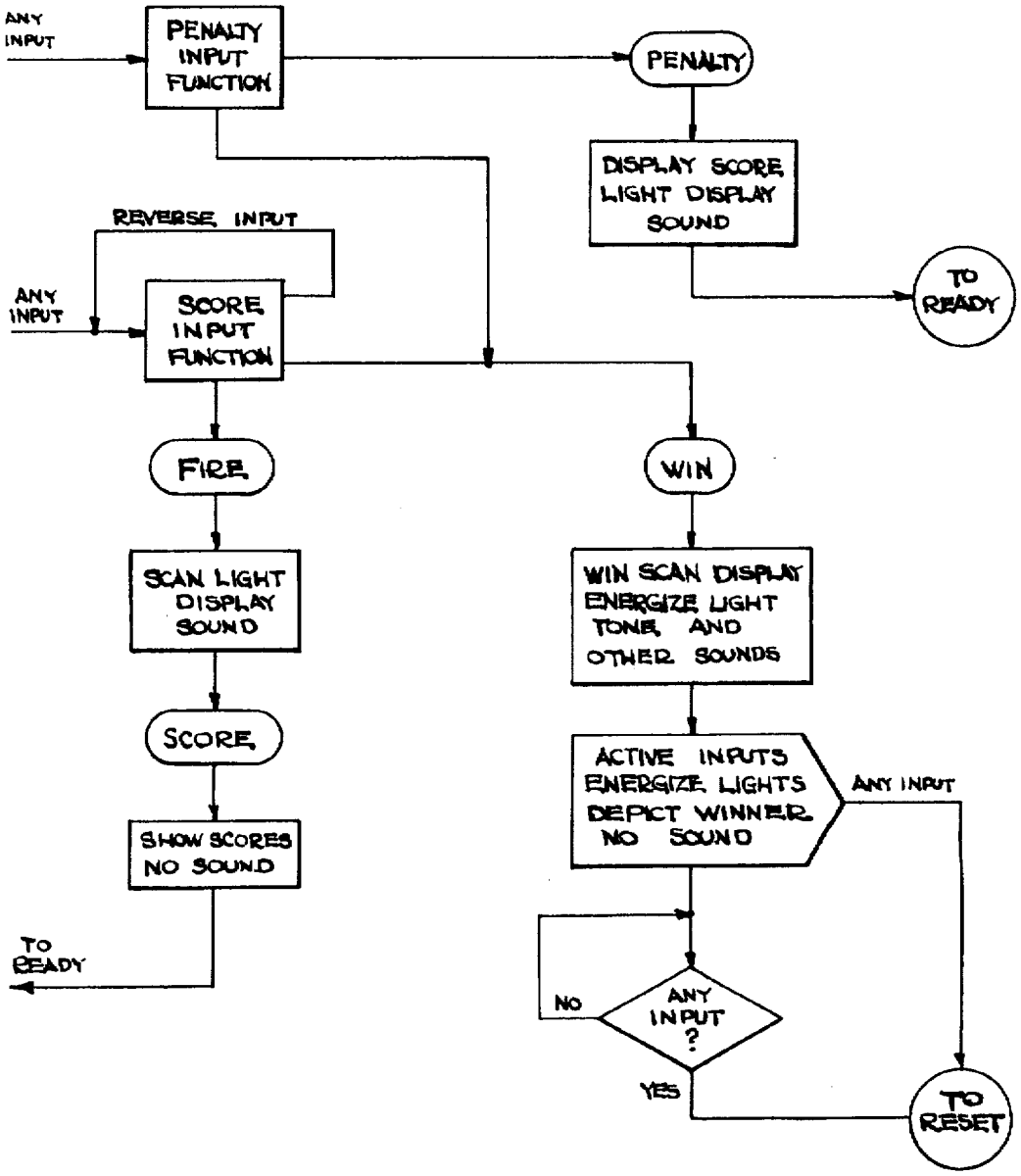
Figure 5:
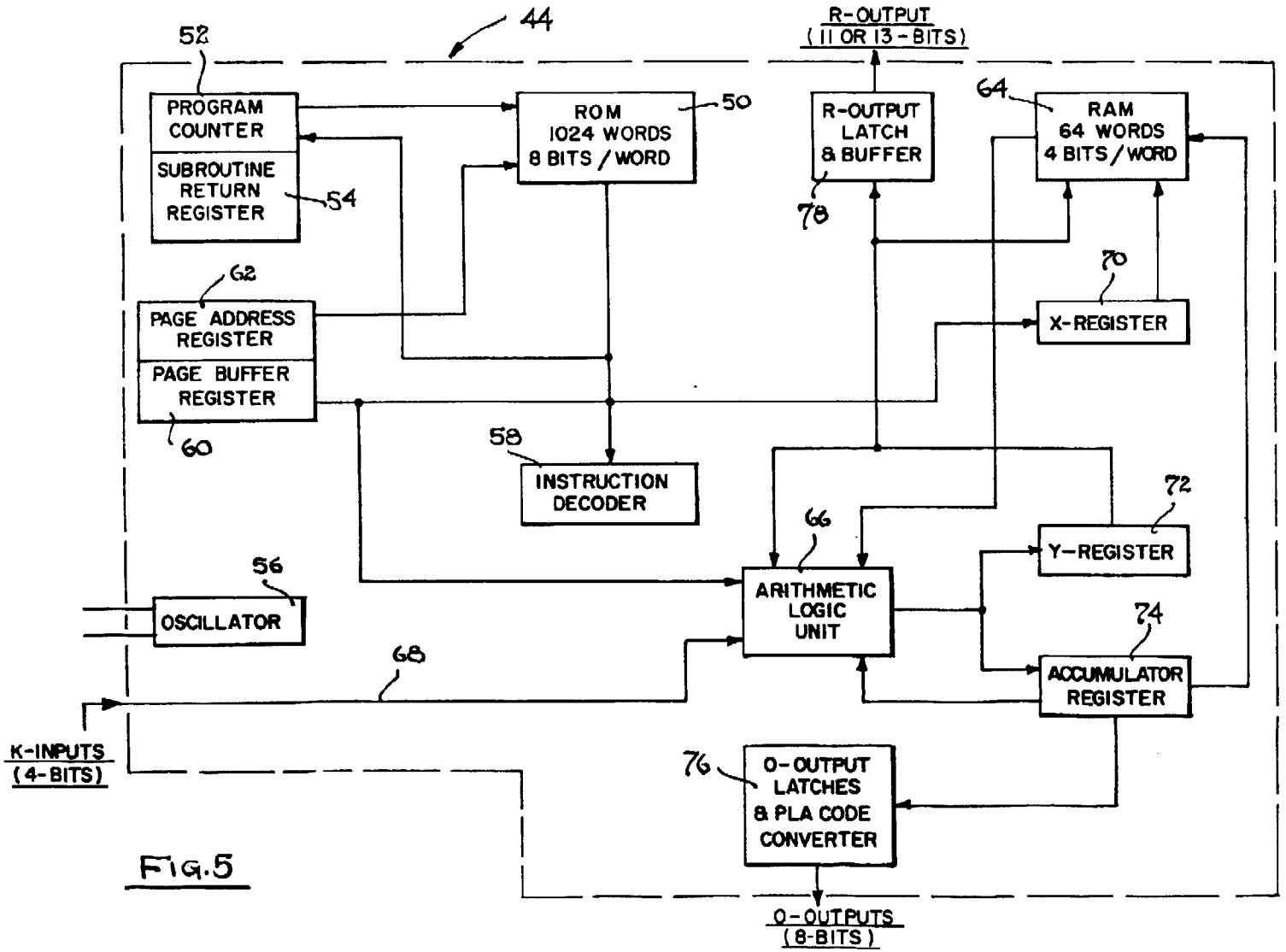

Having thus described the invention in general terms, reference will now be made to the accompanying drawings in which:

FIG. 1 is a top-plan view of an electronic time reaction game apparatus constructed in accordance with an embodying the present invention;

FIG. 2 is a side elevational view of the time reaction game apparatus showing a portion of the interior of the game apparatus housing in dotted lines;

FIG. 3 is a schematic electrical circuit view showing the connection of the various components to a microprocessor forming part of the time reaction game apparatus of the present invention;

FIGS. 4A and 4B constitute a composite schematic view of a flow chart showing the operation of the microprocessor, as well as some of the other components forming the electronic circuitry of the present invention; and FIG. 5 is a schematic diagram showing the components of the microcomputer forming part of the apparatus of the present invention.

DETAILED DESCRIPTION

Referring now in more detail and by reference characters to the drawings which illustrate a preferred embodiment of the present invention, A designates an electronic time reaction game apparatus comprised of an outer housing 10 having a top wall 12, a bottom wall 14 and an enclosing side wall 16. Moreover, the housing 10 is provided with a first player end 18 and a second player end 20.

The first player end 18 is provided with a first player actuable response switch 22 and a second player actuable response switch 24. The player actuable response switch 22 is a forward actuating switch, designated as "F", and the switch 24 is a rearward actuating response switch, designated as "R". In like manner, the player end 20 is similarly provided with a first player actuable response switch 26 and a second player actuable response switch 28. Again, the response switch 26 is a forward actuating response switch and the switch 28 is similarly a rearward acting switch, in a manner to be hereinafter described in more detail.

Also located on the top wall 12 at the player end 18 are a plurality of lights 30 (six as shown), preferably in the form of light-emitting diodes. In like manner, located at the right-hand end 20 are a plurality of lights 32 (six as shown) and also which are present in the form of light-emitting diodes.

The housing is also provided in the approximate center portion thereof with a light socket 34 which receives a conventional incandescent bulb 36 and which is covered by a translucent dome 38, the latter of which may be provided with any desired form of design. The light 36 is a score indicating light, and preferably a game winner indicating light, and will be energized in a manner to be hereinafter described in more detail.

The housing is provided on the enclosing side wall 14 with an on-off switch 40 of generally conventional construction. In addition, mounted within the housing 10 is a conventional speaker 42 capable of generating any of the desired sounds as hereinafter described.

FIGS. 2 and 3 schematically illustrate one form of connecting the various electrically operable components to an electronic processing means, as for example, a microprocessor 44, which is located within the housing. In this case, the microprocessor 44 is of conventional construction, generally in the form of an integrated circuit chip. The microprocessor is properly programmed in order to perform those actions which are desired and as are hereinafter described in more detail. In addition, a schematic circuit diagram of one form of microprocessor is shown and described hereinafter along with a flow chart of the operation thereof. The microprocessor 44, as well as the other components forming part of the game device of the invention, may be operated by a conventional source of battery power, e.g., a dry-cell battery 46, in the manner as illustrated in FIGS. 2 and 3. It should be understood in this respect that the housing 10 would be provided with brackets or the like in which to properly mount the circuit board or circuit chip forming the microprocessor 44, the battery 46, as well as the other components, as for example, the speaker 42.

The housing 10, as well as the various brackets or retaining means for holding the various components, could all be formed in an integral construction. Moreover, the housing, as well as the brackets and other retaining means, could be formed of a suitable plastic material in a conventional plastic molding operation.

However, the housing could be formed of other materials such as metals, reinforced plastics or the like. The player actuable response switches, such as the switches 22, 24, 26, and 28 are all of conventional construction and are generally of the type which will initiate only one signal upon each actuation thereof. Moreover, the microprocessor 44 is programmed so that after the initiation of any start signal, as hereinafter described, the players at each player end can only press one of the response switches at its player end only one time. In this way, the players have to wait for another start signal in order to provide any further response action.

In the case of the present invention, a game cycle starts with the initiation of a game which begins with a ready signal and a subsequent start signal. The first of the players to properly actuate their response switches and first obtain energization of all of the score indicating lights at that player end will achieve a score or otherwise win the game, and with the energization of all of the lights, as for example the six as shown, this will complete a game cycle. Thus, in the preferred embodiment of the invention, a player may win the game when he is the first to have all six lights energized. Otherwise, the game could be played with subsequent game cycles in order for the player to win the game.

In one mode of play, a pair of opponent players can play the game and the game is initiated by pressing one or more of the response switches. The microprocessor would be programmed to recognize the signal which starts the game cycle. In addition, the game may be played in alternate forms, and the microprocessor could be easily and conventionally programmed in order to provide alternate game forms as described above. In like manner, the on-off switch would be turned on in order to permit energization of the microprocessor 44.

When using the game apparatus in a preferred embodiment, the players will first receive a ready signal. After a randomly varying time interval, which is unknown to the players, the microprocessor will cause the speaker or the lights, or both, to generate a start signal. Immediately after receiving the start signal, the players actuate the forward response switch and the first to actuate this forward response switch will achieve energization of the first of his lights 30 or 32. Thus, if the player at the player end actuating the forward switch 22 is the first to actuate his switch, the first of the indicator lights 30 will be energized.

Thereafter, the microprocessor will then initiate a second ready signal which is followed by a second start signal. Here, again, the second start signal is generated after a randomly varying time interval from the generation of the second ready signal. The amount of time from the ready signal to the start signal will vary with each subsequent ready signal so that the players never know when the start signal will occur. This increases the anticipation and excitement in the play of the game apparatus.

Upon subsequent ready and start signals, the players again attempt to actuate one of their response switches, as for example, the switches 22, 24, 26 and 28. Again, the player to first actuate the proper response switch will again achieve energization of the next light in succession at his player end. As indicated previously, the first player to achieve energization of all of his lights 30 or 32, and the subsequent energization of the bulb 36, will achieve a score or otherwise win the game.

The game could be played with only one response switch so that each player merely attempts to be the first to actuate his response switch and energize each of the lights in sequence. However, in a preferred embodiment of the present invention, the players must anticipate the opponent player's reaction. Thus, if one player, as for example at the player end 18, actuates the forward switch 22 before the opponent player at the player end 20 actuates the rearward acting response switch 28, the player at the end 18 will energize an additional light 30. However, if the opponent player at the player end 20 first actuates the rearward acting or reverse switch 28, then one of the lights 30 at the player end 18 will become de-energized.

In the event that both players attempt to actuate their reverse response switches, then the player first succeeding in actuating his response switch will not only achieve energization of an additional light, but will cause de-energization of one of the opponent's lights.

Thus, it can be observed that when both players actuate the reverse response switch, a multiplier effect will result. Hence, the reverse switch provides a much greater advantage in achieving a score, but carries the attendant risk of a much greater net score loss. The use of the reverse switch is effective when an opponent player has achieved energization of almost all of his lights. Thus, the losing player must attempt to prevent the winning player from winning the game by energizing one or two lights and will take every effort to reduce the score of the winning player. The use of the reverse button also presents an added psychological advantage when a score may be tied and one player attempts to reduce the opponent's score.

In accordance with this embodiment of the invention, it can be observed that the players must each anticipate the opponent player's potential move. Thus, one player must anticipate whether the opponent player will actuate the forward switch or the reverse response switch after each start signal. Thus, the player must then decide which of his response switches to actuate. After making this decision, the players await the start signal and then immediately respond to the start signal and attempt to be the first to actuate their selected response switches.

The first of the players to obtain energization of all of his lights will either achieve a score or win the game, as aforesaid. At this point, the microprocessor will cause energization of the central bulb 36. In addition, the microprocessor may also cause the speaker to generate sounds indicative of a winning of the game or a score, or otherwise sounds of amusement, as for example, a musical score, or the like. After a predetermined time interval, the sounds will stop and the lights will all become de-energized so that a new game cycle can be initiated.

As indicated previously, it is also possible for one player to play the game against the apparatus itself. Thus, the microprocessor can be properly programmed to initiate a response after a predetermined time interval. In this case, the player must attempt to actuate a switch prior to a signal representing an actuation of a response switch by an opponent player, but which signal is, of course, generated through the microprocessor.

Again, alternate forms of play could be provided in the game apparatus. Thus, the players may be required to be the first to actuate the appropriate response switch after two or more successive start signals in order to obtain energization of any one of their lights. Again, other forms of play could be programmed into the microprocessor.

FIG. 4 illustrates a typical flow chart for the various steps which take place through operation of the microprocessor 44 during the play of the game of the present invention. In this case, it can be observed that after a start operation is initiated, the microprocessor 44 will cause initiallization of the input-output relations. In this step the microprocessor is provided with the information where the input data is to be stored and where the output lines to the light-emitting diodes and speakers are initially set to the on or off condition. Further, internal storage spaces are cleared and reset and possibly set to predetermined numbers.

After the initiation of the input-output information has been executed and completed according to instructions in a read-only memory 5 (hereinafter described), a display sequence is initiated in which a software timer is set to provide a time limit. A program, or subroutine thereof, sets into motion the timing of the light-emitting diodes and/or the speaker to generate sounds in a random fashion, or otherwise, a pseudo-random fashion, in order to generate either a random sequence or a pseudo-random sequence of tones on the speaker or lights from the light-emitting diodes.

When the power is first turned on, a random access memory, forming part of the microprocessor, is cleared, except for the locations serving as random variables. This clearing of the random access memory insures that different random sequences will occur at each power-on condition.

When the game begins, there may optionally be a random blinking of the light-emitting diodes 30 and/or a tone in the form of a song may be generated over the speaker 42. This random blinking of the lights 30 and/or the generation of the sound may serve as a greeting.

The game may be provided with a test mode and in this case, a testing of the entire apparatus comprises a passive test part and an active test part. The passive test occurs by lighting some, or all, of the light-emitting diodes 30 and generating a continuous tone on the speaker 42 for a predetermined period, as for example, two seconds. During the passive test interval, the active test will also be initiated by pressing any of the player switches. This will stop the tone and cause a specific grouping of the light-emitting diodes 30 to be energized according to any desired sequence. One such sequence which may be adopted is that set forth in the following Table I:

TABLE I

| PLAYER 1 | 1 | 2 | 3 | 4 | 5 | 6 | 36 | 6 | 5 | 4 | 3 | 2 | 1 | PLAYER 2 |
|---|---|---|---|---|---|---|---|---|---|---|---|---|---|---|
| REVERSE | X | X | X | X | — | — | — | — | — | — | — | — | — | — |
| FORWARD | — | — | — | — | X | X | X | — | — | — | — | — | — | — |
| — | — | — | — | — | — | — | X | X | X | — | — | — | — | REVERSE |
| — | — | — | — | — | — | — | — | — | — | X | X | X | X | FORWARD |

The lights 30 may be energized as long as the last-mentioned player response switch is pressed and only one switch may be tested at a time. After this latter player switch is released, the passive test may again begin and the other switches may be tested sequentially. When the last switch is released, the test time will run out and the game is programmed to proceed to begin the play of the game apparatus.

In the aforesaid Table I, the first six lights associated with each of the players represent the light-emitting diodes 30 on each side of the game apparatus. The light designated as 36 in Table I is the main light 36, as illustrated in FIG. 1.

After the greeting, if any, the apparatus enters a pause mode which will last for a predetermined period, e.g., of about three seconds. In this latter mode, there are no sounds or lights energized, but the player input switches or so-called player response switches 22, 24, 26, and 28, remain in an active state. If no input is made during the pause period, the game will proceed to a ready state and assume the beginner's speed mode. However, during the pause period, the player or players, may select one of three other game modes, as hereinafter described.

There are four distinct ways in which the game apparatus of the present invention may be played, and which include a beginner mode, an intermediate mode, and an advanced mode (for two players), and a solo mode. The first three modes determine the speed at which the game plays by progressively shortening the time in which a player may respond to a score or action of another player. The solo mode allows one person to play against the game, as aforesaid. While the present invention may be adapted to play the solo mode in either the beginner, intermediate, or advanced speeds, in the present invention, it is designed to play at the advanced speed mode. The game modes are set during the pause period according to the following Table II:

TABLE II

| SWITCH | MODE |
|---|---|
| 1R or 1F | SOLO |
| 2R | INTERMEDIATE |
| 2F | ADVANCED |

The program introduced into the microprocessor 44 then causes the apparatus to shift to the ready state which is the first phase of the normal game play sequence. In this respect, the test mode could be eliminated. The duration of the ready state is about 1.5 seconds, although this could be varied, and the lights 30 of both players may blink in an alternate odd-even fashion, accompanied by a beeping tone in synchronization with the blinking lights. No player input switches are activated at this time. The game then moves to a set condition and this is the second phase of the game which is designed to add suspense to the play of the game apparatus.

The duration of the set period is randomly determined by the microprocessor, although there are maximum and minimum limits, approximately one through four seconds. The set period is identified by the generation of the players sensory perspective ready signal, as for example, a loud beep from the speaker 42. During the set period, that is, the period preceding the ready signal, all inputs are active although there is no light display or sound generation.

If none of the player response switches are activated during this set period, the game apparatus will proceed to the go state. However, if any of the players actuates one of the player response switches too soon, that is, during the set period, the game immediately stops and a penalty is awarded. The game apparatus will then move from the set period to a penalty input function. In this case, the offending player, that is the one who actuated the response switch too soon, enables his opponent to be awarded a point. The offending player may or may not be moved back according to the programming of the game apparatus. In the preferred embodiment, the offending player is not moved back, but the opposite player is awarded the point.

During the penalty phase, the new scores are displayed and this may occur by a blinking of the lights 30 and perhaps the generation of a razzing sound through the speaker 42. The penalty phase may last for approximately 3.5 seconds. In this case, it can be observed that there is a penalty input function sub-routine. If the player (who is not the offending player) has not reached the seventh point, there will just be an additional point added. However, if by the penalty of the offending player, the other player reaches the seventh point, the game will immediately move to win cycle, as hereinafter described in more detail. In the event that the win cycle is not initiated, the game immediately returns to the ready state.

As indicated previously, if there is no player response switch actuated during the set period, the game will move to the GO condition. This is action phase of the game in which each player attempts to be the first to actuate one of the player response switches. The microprocessor can effectively determine the "first input" to within approximately one millisecond. The start signal preferably adopts the form of a warbling tone from the speaker and the lights 30 are sequentially energized so as to appear to stream down from the main light 36. The time available in which the players may react is established by the mode of the game and may also be shown visibly by the numbers of lights 30 which are energized. The following Table III lists the speeds in terms of the lights 30 which are energized.

TABLE III

| MODE | NO. OF LIGHTS ON |
|---|---|
| BEGINNER | 10 |
| INTERMEDIATE | 6 |
| ADVANCED & SOLO | 3 |

The action during the GO stage will depend on the player response switch which is first actuated. If the first input based on the first player response switch being actuated is a forward input, then the score will be updated and the FIRE sequence will begin immediately. However, if the first input is based on the actuation of the first reverse player response switch, the tone of the warble will change slightly and during the rest of the GO interval, the program will sense for a reverse input from the opposite player. If just one reverse input occurs, the opposite player will be moved back one point. However, if the second player also actuates a reverse switch at any time during the GO stage, and after the first reverse switch was actuated, the first player will obtain a bonus score and advance one point, as well as move the other player back one point. Thereafter, the action will then proceed to the FIRE sequence. The game is programmed with one exception to occur during the game sequence if the result of the score update moves a player to the 7th level, that is, in which the light 36 is energized. In this latter case, the program jumps immediately to the WIN sequence.

In the event that there is a default, that is, if no inputs are realized during the GO stage, the game will default and both players will lose one point. The scores will be displayed by a slow blinking of the lights 36, and the speaker 42 will generate a razz sound. The default will last for a predetermined time, typically, four seconds. Further, the game apparatus is programmed so that after three defaults in a row, the game apparatus will enter a stand-by mode. If three defaults in a row do not occur, the game apparatus will return to the ready stage for the next round of play. In the solo mode, the object is to advance the other player, which in this case, is the apparatus itself, and move the one player backwards, and this may result in a jump to the WIN sequence.

In the stand-by mode, and after the third default in a row, all of the lights 30 are de-energized and no output from the speaker is generated. During this particular period of time, if any input player response switch is actuated, the play will resume at a ready state and the default counter in the apparatus will be reset.

If a successful score was made during the GO phase, but which did not result in a WIN of the game, the apparatus will respond by means of the lights 30 being energized sequentially from the side of the scoring player and scanning across all of the lights of the player up to the center light 36, if the score was obtained by actuation of a forward switch. Otherwise, if the score was obtained by actuation of a reverse player switch, a scanning of the lights will be initiated from the center light 36 across all of the six lights of that particular player winning the score. The scanning may be accompanied by a falling tone generated from the speaker 42.

The duration of the FIRE stage is about three seconds. After the completion of the FIRE stage, the new scores will be displayed continuously for about three seconds, which occurs in a scanning up or across the display. Further, a constant tone in the form of a whooping sound will be generated in the score stage, and after the score stage, the sequences will return to the ready stage for the next round of the game. If the new score, after a GO period, a penalty period, or a default, moves the player into the seventh level of lights, that is, the light 36, the program is designed to initiate the WIN sequence. In this case, a stream of lights 30 rapidly scan up from the player toward the light 36 and back. This may be accompanied by a whooping tone over the loud speaker. Further, the sound may, in the preferred embodiment, adopt a series of six rapidly rising tone whoops and then a theme of a particular song. After the song has ended, all sound goes off and the display may change to slowly blink all of the lights 30 on the winning players side. This entire display may last about five seconds and then all lights are de-energized. Thereafter, the program moves the game to a reset for the start of a completely new game.

The program may be designed to include a bonus score. After the first input generated by any one player actuating a player response switch, and during the GO phase, if it is a reverse input, the program enters the special score mode to look for reverse input from the other player, while also checking the remaining time left for the GO phase. As soon as a reverse input occurs by the other player, the apparatus registers this as a bonus score and immediately shifts to the FIRE sequence. If no reverse input occurs, the program will immediately jump to the FIRE sequence one loop time sooner than the GO would have otherwise reached to enter a default.

The following Table IV represents a summary of the scoring rules for both the solo mode and the two player mode.

TABLE IV

| MODE | 1ST INPUT | 2ND | SCORE | LIGHTS |
|---|---|---|---|---|
| SOLO | 1F | — | +PL1 | PL1 to Center |
| | 1R | | −PL2 | PL1 to PL2 |
| | Default | — | −PL1 +PL2 | blink scores |
| 2 Players | 1F | — | +PL1 | PL1 to CENTER |
| | 2F | — | +PL2 | PL2 to CENTER |
| | 1R | — | −PL2 | PL1 to PL2 |
| | 2R | — | −PL1 | PL2 to PL1 |
| | 1R | 2B | +PL1 −PL2 | PL1 to PL2 BONUS |
| | 2R | 1B | −PL1 +PL2 | PL2 to PL1 BONUS |
| | Default | — | −PL1 −PLs | Blink Scores |

In each case, and in each of the tables, the 1F represents a first player actuating a forward player switch and a 1R represents a first player actuating a reverse player switch. In like manner, 2F represents a second player actuating the forward switch and 2R representing the second player actuating the reverse switch. PL1 represents the first player and PL2 represents the second player. A + preceeding either of the players indicates a positive score and a − sign indicates a negative score.

FIG. 5 more fully illustrates a schematic block diagram of one form of integrated circuit chip, which may be used as a microprocessor, and which illustrates the components forming part of the microprocessor. In this case, the term microprocessor is generally used synomously with the term "microcomputer". The microprocessor 44 generally comprises a read-only memory, or so-called "ROM" 50, which contains the storage for the program which is employed.

In one embodiment of the present invention, a microcomputer offered by Texas Instrument Company, and which exists in the form of a single integrated circuit chip designated by the trade name "TMS 1000" may be employed as the microcomputer. This particular microcircuit chip is a dedicated chip in which one layer thereof may be suitably programmed with proper program steps in order to perform the various functions of the game heretofore described. Thus, the one particular layer may be programmed in accordance with the flow diagram as heretofore discussed. Thus, the program representative of this flow diagram is effectively introduced into the read-only memory 50.

The read-only memory 50 operates in conjunction with a program counter 52 and a sub-routine return register 54. The program counter 52 and the sub-routine return register 54 are basically designed to keep track of the instructions introduced into the read-only memory 50. The program counter initiates an input to the read-only memory 50 and the sub-routine return register 54 may function as a part of the program counter 52. The sub-routine return register is actually used to implement the sub-routine calls in the program introduced into the read-only memory 50.

The microcomputer also is provided with a timing circuit 56 in the form of an oscillator and which generates timing signals for all of the various components illustrated in the circuit chip 44. In this case, it should be understood that the various flow lines as illustrated in FIG. 5 actually show the movement of data and do not necessarily describe the actual interconnection of the various components. In this respect, it should be understood that the oscillator 56 would essentially be connected to practically all of the components as illustrated, in order to provide the proper timing signals thereto.

The microcomputer 44 also comprises an instruction decoder 58 which receives an output from the read-only memory 50 and implements specified sequences of connection between the various components forming part of the microcomputer 44. In this respect, the program counter 52 has an output which is connected to the read-only memory 50. Further, outputs of the read-only memory 50 are introduced into a page buffer register 60 which operates in conjunction with a page address register 62, and the latter of which has an input to the ready-only memory 50. The page address register, 62 and the buffer register 60 are designed to further address and access data which is in the read-only memory 50.

The microcomputer 44 further comprises a random access memory 64 which is used to store variable data quantities used in various operations and which are provided for execution of the program introduced into the read-only memory 50. In this respect, the read-only memory 50 is designed to store 1,024 eight-bit words, and the random access memory 64 is designed to store 64 four-bit words. The microcomputer 44 also comprises an arithmetic logic unit 66 which is designed to receive and operate on data introduced into the read-only memory 50 in accordance with the instructions which have been introduced into the read-only memory 50. The arithmetic logic unit 66 receives data from the read-only memory 50, and further, receives data from the random access memory 64 in the manner as illustrated. In addition, information may be introduced into the microcomputer 44 through an input 68 and which is also provided for introducing information into the arithmetic logic unit 66.

The random access memory 64 operates in conjunction with an X-register 70 and a Y-register 72. The X-register 70 and the Y-register 72 are designed to address locations in the random access memory 64 and to access the memory therein. In addition, an accumulator register 74 operates in conjunction with the random access memory 64 and supplies information thereto. The accumulator register 74 operates to store data used in the execution of the program and further provides information to output latches 76. In addition, the microcomputer 44 is provided with additional output latches 78 which define the "R-outputs" and the output latches 76 provide outputs which define the "O-outputs". In this respect, the R-outputs may be either 11 or 13-bit words, whereas, the O-outputs are generally 8-bit words. The R-outputs are generally used to control the lights and the sounds, whereas the O-outputs are used to control other operating features in accordance with the flow chart previously described.

The various components heretofore described as forming part of the microcomputer receive information inputs in the manner as illustrated in FIG. 5. The software program may be embedded in the microcomputer during wafer processing by a single-level mask technique, which in essence defines the fixed read-only memory pattern.

In order to start the sequence of operation, the power to the microprocessor 44 is first initiated by turning on the off-on switch 40. The oscillator 56 will start generating the timing signals for the operation of the microprocessor 44. The program counter 52 then provides location information to enable accessing a certain location in the read-only memory 50 in which the first instruction is obtained. This instruction is then introduced and loaded into the instruction decoder 58, and this, in turn, establishes various instruction paths between the various elements of the microprocessor 44, depending upon the specific instruction itself.

This process is then repeated over and over with a program counter 52 then advancing to the next instruction contained in the read-only memory 50. External numeric inputs to arithmetic logic unit 66, e.g., four-bit K inputs would also be initiated by the instruction decoder 58. The K inputs essentially represent the only means for introducing numeric information into the processor chip.

After information is introduced into the arithmetic logic unit, for example, the next instruction could be the setting of the X-register 70 and the Y-register 72 to address a location in the random acccess memory 64. A following instruction could transfer that information from the arithmetic logic unit 66 into the random access memory 64. Other instructions would be used for introducing data into the accumulator register 74, functions such as light energization or sound is created by instructions which are introduced into the output latches including the latches 76 and 78. These instructions to the latches 76 and 78 control the pattern of the visual light display and sound generation.

Additional instructions might be loaded into the Y-register 72 for setting the R output latches 78 to generate a sound effect, either individually or simultaneously along with the visual display. Certain instructions may also be used to initiate the subroutine return register 54 for accessing other locations in the read-only memory 50 to initiate subroutines in accordance with the program. Thus, the microprocessor will function in a known manner in accordance with the instructions contained in the program introduced into the microprocessor. As indicated above, one form of program is that represented by the flow chart of FIG. 4.

Thus, there has been illustrated and described a unique and novel time reaction game apparatus in which a player attempts to react as quickly as possible to a start signal to actuate a response means to thereby achieve a score, and which therefore fulfills all of the objects and advantages sought therefor. It should be understood that many changes, modifications, variations, and other uses and applications of the time reaction game apparatus will become apparent to those skilled in the art after considering this specification and the accompanying drawings. Therefore, any and all such changes, modifications, variations, and other uses and applications which do not depart from the nature and spirit of the invention are deemed to be covered by the invention which is limited only by the following claims.

Having thus described my invention, what I desire to claim and secure by Letters Patent is:

1. An electronic time reaction game capable of being played by one or more players, said game comprising:
   (a) a base means,
   (b) electronic processing means associated with said base means for initiating a game cycle by generating a player sensory perceptive ready signal, initiating a randomly or apparently randomly varying time interval of duration unknown to the player and generating a player sensory perceptive start signal at the end of said time interval,
   (c) player actuable response means on said base means and being operatively connected to said electronic processing means and where a player of the game attempts to react to the start signal and actuate the response means as quickly as possible to achieve a score, and
   (d) response time indicating means on said base means and being operatively connected to said electronic processing means to generate a player sensory perceptive response time indicative of player response time.

2. The electronic time reaction game of claim 1 further characterized in that said electronic processing means initiates and causes generation of a next ready signal and a subsequent next start signal after the actuation of the player actuable response means and the generation of the response time indicating signal.

3. The electronic time reaction game of claim 2 further characterized in that said player actuable response means comprises a plurality of player actuable switch means.

4. The electronic time reaction game of claim 1 further characterized in that said sensory perceptive ready signal and said sensory perceptive start signal are visual signals or audible signals, or visual and audible signals.

5. The electronic time reaction game of claim 4 further characterized in that said response time indicating means is at least a light means and said response time indicating signal is a visual signal.

6. The electronic time reaction game of claim 4 further characterized in that a plurality of light elements are mounted on said base means and at least one of said light elements constituting said response time indicating means to generate said response time indicating signal and said light elements also providing information to the player sufficient to formulate a strategy with respect to the desired response after the next start signal.

7. The electronic time reaction game of claim 1 further characterized in that two or more opponent players may play the game and said base means is provided with a pair of opposed player ends, and a separate player response means at each of said player ends so that each player response means may be actuated by each opponent player.

8. The electronic time reaction game of claim 1 further characterized in that one player may play the game with the electronic processing means being capable of initiating a signal representative of the actuation of a player response means after a preestablished time period.

9. An electronic time reaction competitive game capable of being played by two or more players, said game comprising:
   (a) a base means having a pair of player ends,
   (b) sound generating means,
   (c) electronic processing means operatively connected to said sound generating means for initiating a game cycle by causing said sound generating means to generate an audible player ready signal, initiating a randomly or apparently randomly varying time interval of duration unknown to the players, and causing said sound generating means to generate an audible player start signal at the end of said time interval,
   (d) a plurality of player actuable response switch means on said base means at each of said player ends, said switch means being operatively connected to said electronic processing means,
   (e) a plurality of response time indicating lights on said base means at each of the player ends and being operatively connected to said electronic processing means to generate one or more of said lights representing a player response time indicative of which player was faster in response to the start signal to actuate one of the response switch means to generate a score.

10. The electronic time reaction game of claim 9 further characterized in that said electronic processing means initiates and causes said sound generating means to generate a next ready signal and a next start signal after the actuation of the player actuable response switch means and the energization of the lights representing a response time.

11. The electronic time reaction game of claim 10 further characterized in that said lights at each player end are energizable in sequence to provide information to the players sufficient to formulate a strategy with respect to the desired response after the next start signal.

12. A method of playing an electronic time reaction game operable with an electronic processing means capable of initiating a game cycle, generating a player sensory perceptive ready signal, initiating a randomly or apparently randomly varying time interval of duration unknown to the players of the game, and generating a player sensory perceptive start signal at the end of said varying time interval, said method comprising:

(a) awaiting a start signal, (b) attempting to anticipate an adverse action which would reduce the player's score and determining which of a pair of actuable player response switches should be actuated in response to said start signal and the anticipation of the adverse action in order to maximize the player's score, (c) actuating either of said pair of actuable player response switches as quickly as possible in response to the generation of the start signal and achieving a score if the response to the start signal and acutation of the response switches was quick enough generate a score, and (d) thereafter awaiting subsequent ready signals and start signals and actuating the player response switches as quickly as possible after each start signal in an attempt to maximize a player's score.

13. The method of playing the electronic time reaction game of claim 12 further characterized in that said sensory perceptive ready signal and said sensory perceptive start signal are visual signals or audible signals, or visual and audible signals.

14. The method of playing the electronic time reaction game of claim 13 further characterized in that a plurality of light elements are provided in said game and at least one of said light elements indicating a player's response time and said player formulating a strategy with respect to the desired response after the next start signal from said light elements.

15. The method of playing the electronic time reaction game of claim 13 further characterized in that the player selects and actuates one of a plurality of player actuable response switches.

16. The method of playing the electronic time reaction game of claim 12 further characterized in that two or more opponent players may play the game from each of a pair of opposed player ends, and with a separate player response switch at each of said player ends so that each player response switch may be actuated by each opponent player.

17. The method of playing the electronic time reaction game of claim 12 further characterized in that one player may play the game with the electronic processing means being capable of initiating a signal representative of the actuation of a player's response after a preestablished time period.

18. An electronic time reaction competitive game capable of being played by two or more players, said game comprising:

(a) base means for defining a plurality of player areas, (b) signaling means operatively associated with said base means for producing ready and start signals for the players, (c) a plurality of lights associated with said base means for each of the plurality of players, (d) electronic processing means operatively connected to said signaling means for initiating a game cycle by sequentially (i) causing said signaling means to generate a player ready signal, (ii) initiating a randomly or apparently randomly varying time interval of duration unknown to the players, and (iii) causing said signaling means to generate a player start signal at the end of said varying time interval, (e) a plurality of player actuable response switch means on said base means at each of said player areas, said switch means being operatively connected to said electronic processing means and where each player of the game attempts to react to the start signal and actuate a selected response switch means at that player's area as quickly as possible to achieve a score, and said electronic processing means operating to cause at least one or more of said lights to become energized or said sound generating means to generate an audible signal, or both to operate, to thereby provide a player response time signal indicative of which player was faster in response to the start signal to actuate one of the response switch means.

19. The electronic time reaction game of claim 18 further characterized in that said electronic processing means initiates and causes generation of a next ready signal and a subsequent next start signal after the actuation of the player actuable response means and the generation of the response time signal.

20. The electronic time reaction game of claim 18 further characterized in that said lights at each player area are energizable in sequence to provide information to the players sufficient to formulate a strategy with respect to the desired response after the next start signal.

21. The electronic time reaction game of claim 18 wherein:

said signaling means generates audible player ready signals and/or visible player ready signals; and said signaling means generates audible player start signals and/or visible player start signals.

* * * * *